US012241215B2

(12) United States Patent
Scholl et al.

(10) Patent No.: US 12,241,215 B2
(45) Date of Patent: Mar. 4, 2025

(54) VEHICLE, SYSTEM AND METHOD FOR RAILWAY TRACK CLEARING

(71) Applicant: Aitonomi AG, Ennetmoos (CH)

(72) Inventors: Torsten Scholl, Duesseldorf (DE); Xenia Scholl, Duesseldorf (DE)

(73) Assignee: AITONOMI AG, Ennetmoos (CH)

( * ) Notice: Subject to any disclaimer, the term of this patent is extended or adjusted under 35 U.S.C. 154(b) by 936 days.

(21) Appl. No.: 17/413,270

(22) PCT Filed: Feb. 9, 2021

(86) PCT No.: PCT/IB2021/051031
§ 371 (c)(1),
(2) Date: Jun. 11, 2021

(87) PCT Pub. No.: WO2021/161164
PCT Pub. Date: Aug. 19, 2021

(65) Prior Publication Data

US 2022/0228335 A1 Jul. 21, 2022

(30) Foreign Application Priority Data

Feb. 11, 2020 (GB) ..... 2001841

(51) Int. Cl.
*E01H 8/10* (2006.01)
*B61L 15/00* (2006.01)
(Continued)

(52) U.S. Cl.
CPC ..... *E01H 8/105* (2013.01); *B61L 15/0058* (2024.01); *B61L 23/04* (2013.01);
(Continued)

(58) Field of Classification Search
CPC ..... E01H 8/10; E01H 8/105; E01B 27/102; B61K 15/0058; B61K 23/04; B61K 27/04; B61K 27/10; B61K 27/53
(Continued)

(56) References Cited

U.S. PATENT DOCUMENTS 8,888,051 B2 * 11/2014 Mardirossian ..... B61L 29/30 246/111

FOREIGN PATENT DOCUMENTS

CN 104594277 A * 5/2015
CN 206570752 U 10/2017
(Continued)

OTHER PUBLICATIONS

International Search Report for corresponding PCT Application No. PCT/IB2021/051031 mailed May 12, 2021.
(Continued)

*Primary Examiner* — Zachary L Kuhfuss
*Assistant Examiner* — Heaven R Buffington
(74) *Attorney, Agent, or Firm* — Wood, Phillips, Katz, Clark & Mortimer

(57) ABSTRACT

A railway track clearing vehicle and associated systems and methods for removing unwanted material from a railway track wherein the vehicle includes: a propulsion mechanism and an autonomous control system for controlled propulsion of the vehicle along the track; an airflow system, configured to provide and direct an airflow through a conduit towards the railway track; and a sensor system configured to provide information relating to unwanted material on an extent of a railway track. The sensor information is applied to provide and direct an airflow to the extent of the railway track to remove sensed unwanted material and to control the propulsion mechanism for travel on the extent of the railway track at a suitable speed according to continual feedback of
(Continued)

the sensor information indicating a state of the unwanted material.

18 Claims, 6 Drawing Sheets

(51) Int. Cl.

| | |
|---|---|
| ***B61L 23/04*** | (2006.01) |
| ***B61L 27/04*** | (2006.01) |
| ***E01B 27/10*** | (2006.01) |
| *B61L 27/10* | (2022.01) |
| *B61L 27/53* | (2022.01) |

(52) U.S. Cl.
CPC ..... *B61L 27/04* (2013.01); *E01B 27/102* (2013.01); *E01H 8/10* (2013.01); *B61L 27/10* (2022.01); *B61L 27/53* (2022.01)

(58) Field of Classification Search
USPC ..... 104/279
See application file for complete search history.

(56) References Cited

FOREIGN PATENT DOCUMENTS

| | | | |
|---|---|---|---|
| CN | 208649980 | U | 3/2019 |
| CN | 109930554 | A | 6/2019 |
| EP | 3 404 145 | A1 | 11/2018 |
| EP | 3461953 | A1 | 4/2019 |
| KR | 20140104132 | A | 8/2014 |

OTHER PUBLICATIONS

Written Opinions for corresponding PCT Application No. PCT/IB2021/051031 mailed May 12, 2021.
Examination Report for United Kingdom Application No. GB2001841.2 mailed Apr. 2, 2020.

* cited by examiner

VEHICLE, SYSTEM AND METHOD FOR RAILWAY TRACK CLEARING

CROSS-REFERENCE TO RELATED APPLICATIONS

This application claims priority from United Kingdom patent application number 2001841.0 filed on 11 Feb. 2020, which is incorporated by reference herein.

FIELD OF THE INVENTION

This invention relates to a railway track clearing device and, more particularly, it relates to a vehicle capable of clearing railway tracks to remove any unwanted material therefrom and an associated system and method.

BACKGROUND TO THE INVENTION

Falling and windblown material on railway tracks is a substantial problem affecting serviceability and maintenance of railways around the world. In areas where vegetation is located close to the railway track, falling and windblown leaves can accumulate on the track and, as a result of rain, stick to the track. The heat and weight of trains passing over the leaves can cause the leaves to turn into a thin, slippery layer on the rail which can make it difficult for trains to accelerate and brake effectively. In addition, a build-up of leaves can form a barrier between the train wheels and sensors on the train or track which may result in train delays since it may be difficult to effectively identify the trains location. In order to avoid the problems associated with fallen and windblown leaves on railway tracks, railway track clearing systems have been developed which travel along the railway and spray the track with strong jets of water so as to remove the fallen leaves from the railway track. Typically, once the leaves have been removed, at least to some extent, an adhesion modifier, which comprises sand and steel shot suspended in a gel-like substance, is applied to the rails. Recently it has also been proposed to blast the rails with a jet of dry ice to thereby avoid the use of the adhesion modifier since the sand and steel shot result in faster wear of the train wheels and rails.

Nevertheless, not only fallen or windblown leaves may cause problems to railway systems. In arid and desert regions, windblown sand on railway tracks can create significant problems. In cold climates, snow and ice on railway tracks can also create problems.

Wind-induced accumulation of sand on railway tracks, as shown in FIG. 1, can significantly jeopardise the safety of trains since it can cause a train to derail. As with leaves, windblown sand may cause problems to sensors, cause significant wear of the railway track and train wheels and even prevent railway track switches to operate properly. Furthermore, windblown sand can cause ballast contamination and since the sand may contain salt, the salt in the sand can result in the contamination of fasteners, degradation of railroad tracks and the like.

Numerous windblown sand mitigation technologies have been developed ranging from destruction or stabilization of sand dunes, sand-modification, diversion of windblown sand or improving the material properties of the infrastructure so as to make the infrastructure more sand resistant.

Nevertheless, very few of these technologies have been implemented with great success. Since substantial amounts of accumulated sand can result in a train derailing, and since sand can build up within very short periods of time, most train operates have opted for the option of significantly reducing the speed at which the train travels along the railway track to enable train conductors to be able to observe problematic areas and react in time by stopping the train. In such cases, a clearing team or vehicle is then typically deployed to remove the sand from the track prior to the train being able to continue its journey.

An exemplary vehicle that is used to remove windblown sand along certain railway tracks in Namibia is shown in FIG. 2. The vehicle is adapted to drive on the railway tracks and has a plough secured to the front thereof. The plough includes two grooves to accommodate the rails of the railway track to thereby enable the plough to remove more sand from the track. However, although functioning fairly well, the vehicle can only remove a top layer of sand since the grooves cannot be made too deep since this could damage the ballast. In addition, the vehicle is also only suitable for a limited amount of sand covering the railway track since the weight of the sand will otherwise be too much for the vehicle to handle.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with an aspect of the invention there is provided a railway track clearing vehicle for removing unwanted material from a railway track, comprising:

- a propulsion mechanism for propulsion of the vehicle along the track under the control of an autonomous control system;
- an airflow system supported by the vehicle and configured to provide and direct an airflow through at least one conduit towards the railway track under the control of an airflow control system; and
- a sensor system configured to obtain sensor information providing information relating to unwanted material on an extent of a railway track;
- wherein the airflow control system applies the sensor information for providing and directing an airflow to the extent of the railway track to remove sensed unwanted material; and
- wherein the autonomous control system applies the sensor information for control of the propulsion mechanism for travel on the extent of the railway track at a suitable speed according to continual feedback of the sensor information indicating a state of the unwanted material.

The airflow system may include an air compressor connected to the at least one conduit to supply the airflow under the control of the airflow control system and at least one conduit may be arranged to be moveable to enable directing the airflow toward a desired location at or near the railway track according to collected sensor information. The airflow system may include two conduits each locating adjacent one of two rails of the railway track and the conduits may be moveable to change the location of the conduits from locating internally of the track between the rails to locating externally of the track and vice versa.

The airflow system may direct the airflow toward the railway track in the direction of travel of the vehicle and/or at an angle to the direction of travel of the vehicle, preferably transverse to the direction of travel, or both in the direction of travel and at an angle thereto. The at least one conduit may be elongate and may include one or both of an outlet at a distal end thereof and one or more outlets along the length thereof. The at least one conduit may be located between the rails of the railway track or adjacent a rail externally of the railway track.

Preferably, two large rectangular conduits are arranged next to each other, with each conduit symmetrically positioned over a respective rail. Each conduit may be inclined towards the ground and slightly outwards. An outlet from the conduit may be positioned a short distance above the railway track.

The airflow system may be supplemented with a roller brush system, mounted on the vehicle and positioned to contact the railway, which is operable to scrub the railway thereby to facilitate loosening of the unwanted particles from the railway track.

The railway track clearing vehicle may include a passive or an active cooling system for cooling one or more of the propulsion mechanism, the autonomous control system, the airflow system and the sensory system. The passive cooling may be achieved by thermal insulation of components of the relevant mechanism or system and may be supplemented by airflow resulting from the propulsion of the vehicle. In addition, the active cooling system may be in the form of a liquid cooling system or an internal heating, ventilation, air conditioning system (HVAC system). Preferably, the railway track clearing vehicle is fitted with a cooling system that is a combination of the active system and the passive system.

A filter system may be provided to prevent ingress of airborne particle, resulting from a clearing operation, into at least one of the propulsion mechanism, the autonomous control system, the airflow system and the cooling system. The filter system may be a high-capacity inertial cyclone filter which is positioned to collect and prevent particles from entering the airflow system.

The sensor system may include a processor configured to receive sensor data from multiple sensors configured to sense predetermined conditions relevant for the vehicle's clearing operation, to process the sensor data to obtain the sensor information relating to unwanted material, and to transmit the sensor information to the airflow control system and the autonomous control system.

The sensor system may receive sensor data from multiple sensors provided on the vehicle and/or on the railway track and the sensors being configured to transmit the sensor data to the sensor system directly or via a sensor node for receiving sensor data from multiple sensors. The sensor system may receive data from remote sources relating to external conditions of the vehicle and the extent of the railway track. The sensor system may receive sensor data from multiple sensors of the form of one or more of: a radar sensor capable of detecting unwanted material on the railway track, a wind speed and direction sensor capable of determining the speed and direction of wind traveling over or across the railway track, an auditory sensor capable of detecting a sound made by windblown particles, and a visual sensor, such as a camera, infrared or video recorder, which collects images or video feed of the railway track conditions, which images or video feed may be analysed autonomously using an appropriate system. A protective cover may protect the sensors from ingress of airborne particles into their components.

The sensor system, the airflow control system, and the autonomous control system may be provided by one or more computer systems, each including a processor and a memory configured to provide computer program instructions to the processor to execute the functions of the systems. The computing system of the autonomous control system may communicate with a remote server to thereby receive operating instructions from the remote server and operate the vehicle in accordance with the received instructions.

The vehicle may include a power system for providing power to the propulsion mechanism, the air flow system, and the sensor system, wherein the power system includes a rechargeable battery system capable of running the vehicle in a sealed mode in which no ingress of air is required.

A battery system may be provided so that the vehicle is operable in a battery operation mode or to supplement power supply to the autonomous control system, the airflow system, the sensory system, the cooling system, or the filter system during operation. The battery system may also supply power to the relevant systems when the vehicle is in a standby mode, thereby to enable a "wake-up" signal to be detected when operation of the vehicle is required. The battery operation mode may be triggered by a high load of airborne particles which is detected by one of the sensors of the sensory system. Preferably, the particle load in the air is detected by the auditory sensor.

The vehicle may include a chassis supported by a set of wheels configured to engage the railway track to enable the vehicle to move along the track and the propulsion mechanism may be a motor mounted on the chassis and configured to drive at least one of the wheels to thereby cause the vehicle to move along the railway track. The motor of the vehicle may be any one of an electric motor, a diesel motor, a petrol motor or the like. The vehicle may include an electric alternator to provide electricity for the vehicle or components of the vehicle.

According to another aspect of the present invention there is provided a computer-implemented method for removing unwanted material from a railway track, comprising:

obtaining sensor information providing information relating to unwanted material on an extent of a railway track;

controlling an airflow system supported by a railway track clearing vehicle and configured to provide and direct an airflow through at least one conduit towards the railway track by applying the sensor information to determine an airflow required to clear the extent of the railway track; and controlling a propulsion mechanism of the railway track clearing vehicle to autonomously control the vehicle on the extent of the railway track at a suitable speed according to continual feedback of the sensor information indicating a state of the unwanted material.

The method may be carried out at a railway track clearing vehicle and may include communicating with a remote server and transmitting clearing progress notifications to the server to indicate the progress of a clearing operation being carried out by the vehicle.

The method may include: receiving a clearing operation notification indicating that a particular extent of railway track requires clearing, the notification including information relating to the location of the extent of railway track and the length thereof; controlling the propulsion mechanism of the railway track clearing vehicle so as to travel to the identified extent of railway track; and upon detecting arrival at the identified extent of railway track, commencing a clearing operation including controlling the airflow system to direct airflow toward the railway track so as to remove any unwanted material therefrom.

The clearing operation notification may be received from any one of: a sensor along the railway track, a sensor node along the railway track configured to receive sensor information from a number of sensors along the railway track and to then transmit the sensor information to a computing device, and a remote server.

The clearing operation notification may be received from a sensor indicating a high level of wind-blown particles in the air and activates a sealed mode of operation of the vehicle by battery power only with no ingress of air.

In response to receiving a clearing operation notification, the method may: obtain information regarding any other vehicles travelling or scheduled to travel on the extent of the railway track requiring clearing; and coordinate a clearing operation of the extent of the railway track to remove any unwanted material therefrom with the other vehicles' routes.

The method may: receive, from a sensor located along a railway track, an obstruction notification indicating that the sensor is being obstructed by unwanted material, the notification including a unique identifier associated with the sensor; and transmit a clearing operation notification to the railway track clearing vehicle to cause the railway track clearing vehicle to travel along the railway track to the location of the sensor and commence a clearing operation of the railway tracks so as to remove any unwanted material therefrom.

The notification may include a unique identifier associated with the sensor and the method may include: retrieving, from a database, a list of unique identifiers and identifying the sensor from which the obstruction notification was received; and retrieving, from a database, location information of the identified sensor, the location information including the geographical coordinates of the sensor.

In response to retrieving the location information of the sensor, the method may include: retrieving, from a database, train activity information for the railway track along which the sensor is located, the train activity information including information on trains traveling along the railway track; determining the duration required for the clearing vehicle to reach the geographic location of the sensor and to perform the clearing operation; and determining a suitable time frame for the clearing vehicle to perform the clearing operation without affecting the train traffic along the railway track.

According to a further aspect of the present invention there is provided a computer system for removing unwanted material from a railway track by a railway track clearing vehicle, comprising:

- one or more processors and memory configured to provide computer program instructions to the processors to execute the function of the following systems:
- a sensor system for obtaining sensor information providing information relating to unwanted material on an extent of a railway track;
- an airflow control system for controlling an airflow system supported by a railway track clearing vehicle and configured to provide and direct an airflow through at least one conduit towards the railway track by applying the sensor information to determine an airflow required to clear the extent of the railway track; and
- an autonomous control system for controlling a propulsion mechanism of the railway track clearing vehicle to autonomously control the vehicle on the extent of the railway track at a suitable speed according to continual feedback of the sensor information indicating a state of the unwanted material.

The sensor system, the airflow control system, and the autonomous control system may be provided on a railway track clearing vehicle. The system may include a remote server in communication with the autonomous control system to provide data and operating instructions.

The system may include multiple sensors provided on the railway track clearing vehicle and/or on the railway track, the sensors being configured to transmit the sensor data to the sensor system directly or via a sensor node for receiving sensor data from multiple sensors.

The multiple sensors may be of the form of one or more of: a radar sensor capable of detecting unwanted material on the railway track, a wind speed and direction sensor capable of determining the speed and direction of wind traveling over or across the railway track, an auditory sensor capable of detecting a sound made by windblown particles, and a visual sensor, such as a camera, infrared or video recorder, which collects images or video feed of the railway track conditions, which images or video feed may be analysed autonomously by the computer system.

In accordance with a further aspect of the invention there is provided a computer program product for removing unwanted material from a railway track, comprising a computer-readable medium having stored computer-readable program code for performing the steps of:

- obtaining sensor information providing information relating to unwanted material on an extent of a railway track;
- controlling an airflow system supported by a railway track clearing vehicle and configured to provide and direct an airflow through at least one conduit towards the railway track by applying the sensor information to determine an airflow required to clear the extent of the railway track; and
- controlling a propulsion mechanism of the railway track clearing vehicle to autonomously control the vehicle on the extent of the railway track at a suitable speed according to continual feedback of the sensor information indicating a state of the unwanted material.

Further features provide for the computer-readable medium to be a non-transitory computer-readable medium and for the computer-readable program code to be executable by a processing circuit.

Embodiments of the invention will now be described, by way of example only, with reference to the accompanying drawings.

DETAILED DESCRIPTION WITH REFERENCE TO THE DRAWINGS

Figure 1:
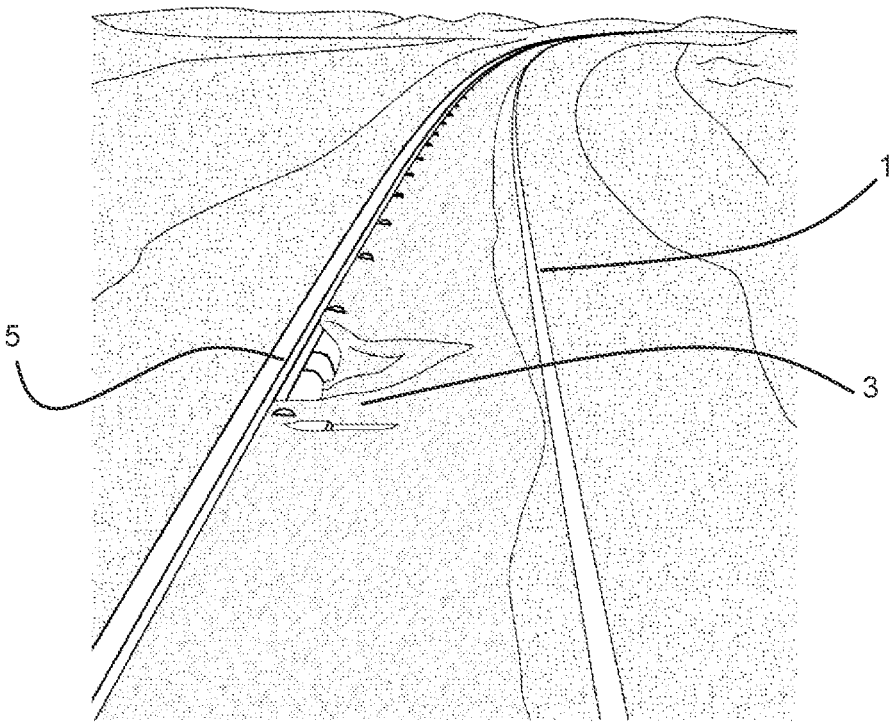
FIG. 1 is an exemplary view of a railway track that has been covered by windblown sand.

A railway track clearing vehicle is described for clearing railway tracks from unwanted material, such as windblown leaves, sand or the like. The railway track clearing vehicle includes a propulsion mechanism for propulsion of the vehicle along the track under the control of an autonomous control system. The propulsion mechanism may be a motor driving wheels or other travel engaging mechanisms, such as magnets of magnetic levitation trains, along the track. The autonomous control system enables the vehicle to autonomously determine a speed at which it is safe for the vehicle to travel by determining and reacting to any unwanted material on the railway track. The autonomous control system may also determine, independently or via communication with a remote server, a location of a railway track that requires clearing and may coordinate movement of the vehicle accordingly.

The vehicle includes an airflow system, for example, supported by a chassis of the vehicle, and configured to provide and direct an airflow through at least one conduit towards the railway track under the control of an airflow control system. The vehicle also includes a sensor system configured to obtain sensor information providing information relating to unwanted material on an extent of a railway track. The airflow control system applies the sensor information to provide and direct an airflow to the extent of the railway track to remove sensed unwanted material. The autonomous control system applies the sensor information for control of the propulsion mechanism for travel on the extent of the railway track at a suitable speed according to continual feedback of the sensor information indicating a state of the unwanted material.

An example embodiment of a vehicle includes a chassis that is supported by a set of wheels that are configured to engage the rails of the railway track to enable the vehicle to move along the track. In order to move along the track, the vehicle may include a motor that is configured to drive at least one of the wheels to thereby move the vehicle. The motor may be a diesel, petrol, electric or other suitable motor. The vehicle may also include an electric alternator to provide for electricity for any components of the vehicle that may require electricity. In addition, the vehicle includes a compressor that is supported on the chassis and which is configured to generate airflow and direct the airflow through at least one conduit toward the railway track to thereby remove any unwanted material from the track.

The railway clearing vehicle is an autonomous vehicle to enable it to perform clearing operations of railway track independently without any or only limited human intervention. In this regard, the vehicle includes one or more computing devices that are configured to drive the vehicle along the railway track and engage the compressor and conduit as required to remove unwanted material from the track. The computing devices may be configured to operate the vehicle independently or to communicate with a remote server and to receive operating instructions from the server and then operate the vehicle in accordance with those instructions. The autonomous nature of the solution will reduce operating costs and allow for operation at times and under conditions that would not be suitable for a manned system.

The aim of the railway clearing vehicle is to clear unwanted material, especially sand, from the track rather than attempting to prevent sand from getting onto the track according to prior art techniques, which has proved ineffective. Unlike the sand plough system (FIG. 2), the railway clearing vehicle may sustain less component wear and reduce wearing of the railway track. The airflow system is particularly effective in clearing light sand encroachment from the railway. Railway tracks covered with a few centimetres i.e., up to about 10 cm, will be effectively cleared by the airflow system. The sand clearing operation may be focused on sand accumulated between the tracks.

In a preferred embodiment, the propulsion mechanism and the airflow control system are electrically driven. The vehicle may, for example, be equipped with a diesel generator to produce at least 100 kW electrical power at two of the wheels/axes which is sufficient to allow the vehicle to maintain speeds up to 90 km/h to traverse the railway track to a clearing location. At this speed, the input power is estimated to be at 80 kW. During a sand clearing operation, the vehicle may travel at about 40 km/h, using about 40 kW to drive the motors. The 100 kW output of the electrically driven motor may be supplemented with a battery system, such as a lithium-ion battery bank of at least 75 kWh to facilitate acceleration or slope/hill ascent of the vehicle. The battery system may also be charged for use during the battery operation mode.

The airflow control system may be operable to specify the air flow rate, delivery pressure of the air, and air jet distribution required to clear the tracks. The air flow rate via an air flow jet is regulated to exert sufficient pressure to move or dislodged compacted or crusted sand without disturbing or displacing the ballast stone. To achieve this, the air flow jet is maintained at a velocity that is below 40 m/s at ballast surface impact. In a sandy environment, particularly, the air supply system may make use of a simple industrial-type centrifugal impeller. In order to clear the tracks efficiently, the power required to run the airflow system with two air conduits or a unit with a double blower head arrangement may, as an example, be in the range of 30 kW, assuming a mechanical efficiency of about 95%, electrical efficiency of about 90% and an aerodynamic efficiency of about 65%.

The vehicle includes one or more sensors that are configured to sense predetermined conditions relevant to the vehicle's operation. The sensors may include radar sensors capable of detecting unwanted material, such as windblown sand or leaves on the railway track, wind speed and direction sensors capable of determining the speed and direction of wind traveling over or across the railway track and the like, an auditory sensor capable of detecting a sound made by windblown particles and a visual sensor, such as a camera or video recorder which collects images or video feed of the railway track conditions, which images or video feed may be analysed autonomously using a suitable system. The vehicle may include a processor capable of receiving sensor data from the sensors, process the data and transmit the data to the computing devices to thereby operate the vehicle. In addition or alternatively, the processor may be configured to communicate with one or more sensors provided along the railway track and to receive sensor information from such sensors, process the sensor information and transmit the processed information to the computing devices to enable the computing devices to operate the vehicle in accordance with the processed information.

A suitable cooling system may be provided to cool the electrical systems of the vehicle. In an example embodiment, a passive cooling system is included to maintain dust ingress protection and to ensure component integrity at ambient temperatures of up to 50° C. Active cooling systems in the form of a liquid cooling system or a HVAC system and thermal insulation may also be included to ensure robustness of the vehicle and onboard systems. A remaining capacity of about 20 to 30 kW from the diesel generator, during constant speed travel on flat ground is available to power the cooling system, the propulsion system, communication power needs and any power surplus could be directed to charge the lithium-ion battery bank as and when required.

In cases where excessive quantities of sand are directed towards an air inlet on the vehicle, and to protect the generator, the autonomous system could switch of the power supply to a battery operation mode in which the battery system may be used as the sole power supply to the airflow system, the electric motor, the cooling system and the processing system for a discrete period of time, for example, up to 45 minutes. The battery discharge current will be high in this scenario and this operation mode must be carefully monitored. Excessive sand blowing conditions could, for example, be detected by the auditory sensor and the processed auditory input signal results in the switch a normal operating mode, where the vehicle is driven by power generated by the generator, to the battery operation mode. In the battery driven mode, air intake into an internal fuel combustion chamber of the generator is not required. Thus, when a sand load in the air is particularly high, and this is detected by the auditory sensors, wear on the generator may be substantially reduced by negating the need of its operation by switching the power supply to battery operation mode.

A solar panel, for example, an array with an output of about 4 kW, may be fitted on the roof of the vehicle to provide power to the systems in storage/standby mode awaiting sand clearing instruction. Power consumption in this mode may be typically be in the range of 1 kW to power the cooling system and about 0.5 kW to power the processing system and communication power requirements. The remainder of the power may be used to keep the battery system charged.

The vehicle may include a sand filter to collect airborne particles generated by the sand clearing operation. Preferably, the filter is a high-capacity inertial cyclone filter on the inlet side of the conduit to rout air to the blower. The inlet of the conduit is typically located at a rear of the vehicle. The air required for the operation of the diesel generator or the cooling system may also be routed through the inertial cyclone filter.

As an example embodiment, the vehicle may have a total mass of about 8 ton comprising:

- 2.5 tons for the vehicle chassis, wheel sets and electric motors;
- 1.5 tons for the vehicle body;
- 1 ton for the airflow system, mounts, ducting and sand filter unit;
- 1 ton for the battery bank, solar panel array, inverter, electrical cables; and
- 0.5 ton for the cooling system and processor etc.

The railway track clearing vehicle, method and system will now be described with reference to the accompanying figures, wherein like reference numerals are used to indicate like features and components.

FIG. 1 an exemplary view of a railway track (1) that has been covered by windblown sand (3). The figure clearly shows the problems that windblown sand accumulation along railway tracks can cause, since it can result in the rails (5) of the railway track to completely or substantially disappear under sand. As will be appreciated, should a train travel along such a railway track at sufficient speed, the accumulated sand may result in the train derailing. In order to avoid this problem from occurring and to enable the train operators from being able to stop a train traveling through an area that exhibits such problems, the trains typically travel at much reduced speeds, such as 20 km/h where in fact such trains can travel at about 80 km/h or more. In addition, to enable train operators to identify the problem, the trains typically only travel through the affected areas during the day.

Figure 2:
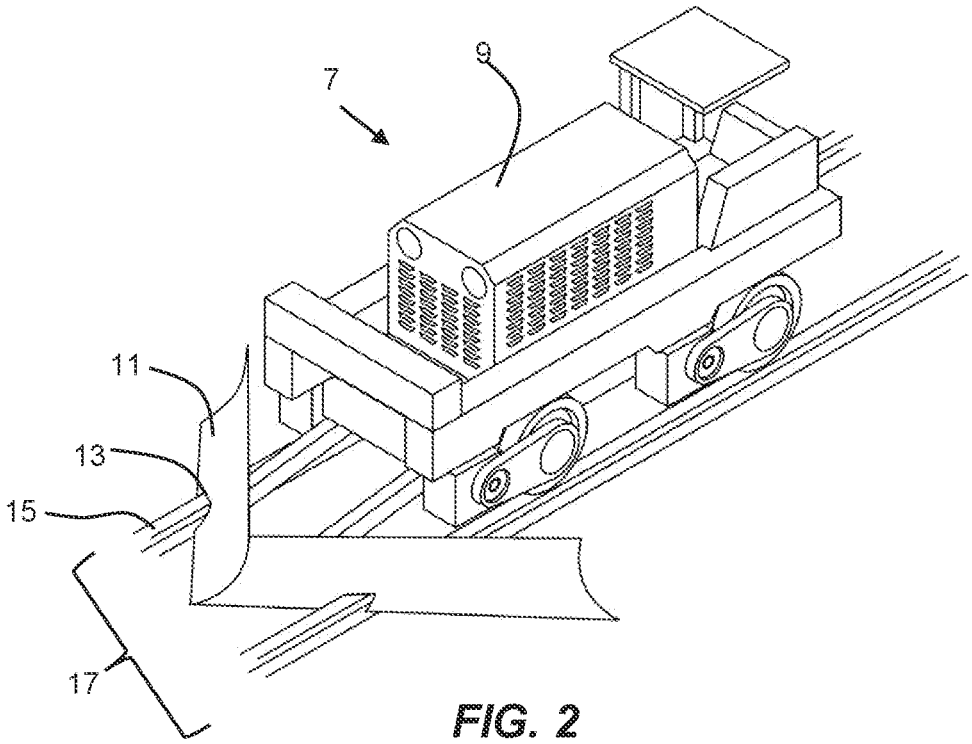
FIG. 2 (PRIOR ART)
FIG. 2 is an exemplary view of a prior art railway track clearing vehicle that includes a plough to remove sand from a railway track.

FIG. 2 illustrates a prior art vehicle (7) that is currently employed in Namibia to assist with the removal of unwanted material, primarily windblown sand, from railway tracks that cross the desert. The vehicle (7) comprises of a conventional diesel locomotive (9) to which a plough (11) is fitted. The plough typically includes grooves (13) that line up with the rails (15) of the railway track (17) to thereby permit the plough to also operate between the rails of the track and remove sand therefrom. However, as mentioned above, the grooves can only be of a predetermine depth so as to ensure that the plough does not damage the ballast during use. In addition, the vehicle is also only usable with a limited amount of sand on the tracks otherwise the weight of the sand being moved by the plough will be too much for the vehicle. In such cases a team of people will need to be engaged to remove a portion of the sand by means of shovels prior to using the vehicle.

Figure 3:
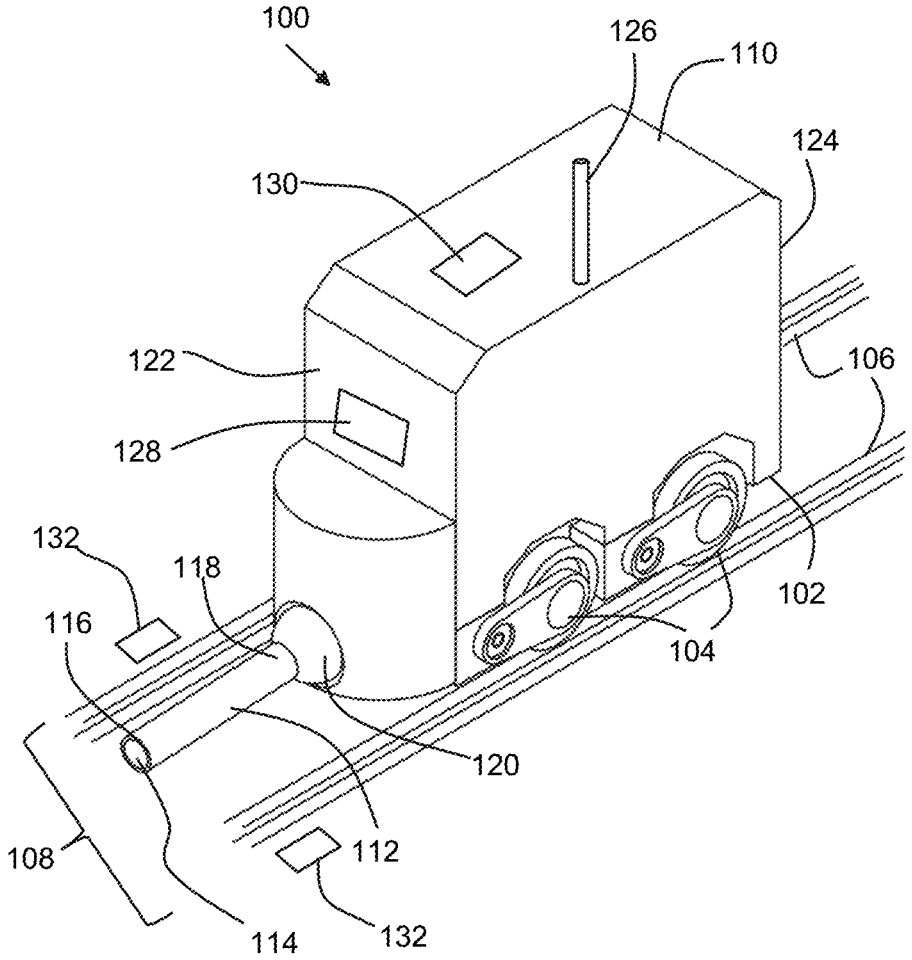
FIG. 3 is a three-dimensional view of an exemplary railway track clearing vehicle according to aspects of the present disclosure, in which the vehicle has one conduit for directing airflow toward the track.

FIG. 3 shows a three-dimensional view of an example embodiment of a railway track clearing vehicle (100). The vehicle (100) includes a chassis (102) that is supported by a set of wheels (104), in this case four wheels, that are configured to engage the rails (106) of the railway track (108) to permit the vehicle (100) to move or drive along the track (108). In order to drive along the track (108), the vehicle includes a motor (not shown) which is housed in a housing (110). The motor may be a diesel, petrol, electric or other suitable motor but preferably is an electrically driven motor powered by an onboard generator and is configured to drive at least one of the wheels (104) of the vehicle (100) to thereby enable the vehicle (100) to drive along the track (108). In addition to the motor, the vehicle (100) may include an alternator (not shown) configured to generate electricity as may be required by components of the vehicle and to charge a battery (not shown) of the vehicle. The alternator and battery are all housed in the housing (110) to protect them from surrounding elements, such as wind, sun, rain and the like.

The vehicle (100) further includes a compressor (not shown) that is supported on the chassis (102) and which is configured to generate airflow that is then directed through a conduit arrangement having at least one conduit (112).

In the embodiment shown in FIG. 3, the vehicle (100) has one elongate conduit (112) that has an outlet (114) at the distal end (116) of the conduit (112) to thereby direct airflow generated by the compressor toward a desired location on the railway track (108) to thereby remove any unwanted material from the track (108). In order to enable directing the airflow to various locations at or near the track (108), the proximal end (118) of the conduit (112) is secured to the housing (110) of the vehicle (100) by means of a ball valve (120) type fitting which permits movement of the conduit about the ball valve (120). It will be appreciated that any other suitable fitting that provides suitable movement of the conduit may also be used. In the embodiment shown, the conduit (112) is provided at a front end (122) of the vehicle (100), however, it will be appreciated that the conduit could also be provided at the rear end (124), alternatively a conduit could be provided on both ends thereby ensuring that should the vehicle have to perform a clearing operation in a rearward direction, it would not first have to turn around, something that is not always possible on railway tracks.

The vehicle (100) is an autonomous vehicle and is therefore capable of performing railway track clearing operations independently without any or limited human intervention. To this end, the vehicle (100) may include computing devices (not shown in FIG. 3), which are again housed in the housing (110). The computing devices may be configured to operate any of the vehicle's (100) components, including operating the motor so as to enable the vehicle (100) to drive along the railway track (108) to a location requiring removal of unwanted material, such as windblown leaves or sand, and engaging the compressor to generate airflow that is then directed toward the problematic areas by means of the conduit (112).

Autonomous vehicles may operate with the computing devices of the vehicle being capable of independently operating the vehicle, in which case the computing device prior to deployment is "taught" its tasks or operations it is or trained to perform and then performs these on its own in future. Alternatively, the computing devices may be configured to receive instructions from a remote server and to then operate the vehicle in accordance with those instructions. In the first case, the computing devices may still be configured to communicate with a remote server to thereby either provide the computing devices with additional data or updates, or even override the computing devices and the like.

The vehicle (100) is also equipped with a cooling system (not shown) to prevent overheating of the electrical components onboard the vehicle. A filter (not shown) is provided at a suitable location to prevent airborne particles from being taken in at the airflow system or generators inlets and interfering with the operation thereof.

In the embodiment shown in FIG. 3, the vehicle (100) is an autonomous vehicle according to the first type, i.e. the vehicle (100) is able to perform clearing operations without the need to communicate with an external server. Since the vehicle (100) is intended to be used in remote areas, such as on railway tracks crossing deserts or vast forests, it is preferred that the vehicle (100) can operate independently without having to receive instructions from a remote server since it may either not be possible to send such instructions, i.e. in the event that there is no signal to communicate or it may simply take too long for the vehicle (100) to receive the instructions to enable effective operation. Nevertheless, and as mentioned above, the vehicle (100) may preferably still be capable of communicating with a remote server or other computing device and to that end includes suitable communication equipment and an antenna (126). It will be appreciated that any suitable wireless communication protocols may be utilised, including third generation (3G), fourth generation (4G), fifth generation (5G) high-speed downlink packet access (HSDPA), general packet radio service (GPRS), and near field communication (NFC) and low-power wide-are (LPWAN) technology such as LoRa™.

In addition, the vehicle (100) preferably includes one or more sensors (128, 130) configured to sense predetermined conditions that may be relevant to the vehicle's (100) clearing operation. In the embodiment shown, the vehicle (100) includes a radar sensor (128) capable of detecting unwanted material, such as windblown sand or leaves, on the railway track (108). Also, a wind speed and direction sensor (130) is provided that may detect the speed and direction of wind traveling over or across the railway track (108). An auditory sensor may be provided, which is capable of detecting a sound made by windblown particles.

The vehicle (100) includes a processor (not shown) that is configured to receive sensor data from the one or more sensors (128, 130), process the data and transmit the data to the computing devices of the vehicle (100) to thereby operate the vehicle, as will be described in more detail further below. Furthermore, the processor may be configured to communicate, via the antenna (126), with one or more sensors (132) provided along the railway track (108) to thereby receive sensor information detected by the one or more sensors (132). The processor may be configured to process the sensor information and to then transmit the processed information to the computing devices of the vehicle (100) to thereby enable the computing devices to operate the vehicle (100) in accordance with the processed information. It will of course be appreciated that the processor may be configured to utilise both the sensor information received from the sensors (132) provided along the railway track and the sensor data detected from the vehicle's own sensors (128, 130) to thereby provided the computing devices with the best possible data for operating the vehicle (100).

The single conduit arrangement shown in FIG. 3 may vary and the conduit arrangement may include multiple conduits that may be disposed to either direct airflow in the direction of travel of the vehicle or to direct airflow at an angle to the direction of travel, preferably transverse thereto. The conduits may have typically outlets provided at a distal end and along the length thereof. The conduit arrangement may also include two conduits as shown below in the example of FIGS. 4A and 4B with each conduit locating adjacent one of the rails, either internally or externally of the track. In this regard, the conduits may be movable to enable changing their location from internally of the track to externally of the track, as may be required.

Figure 4A:
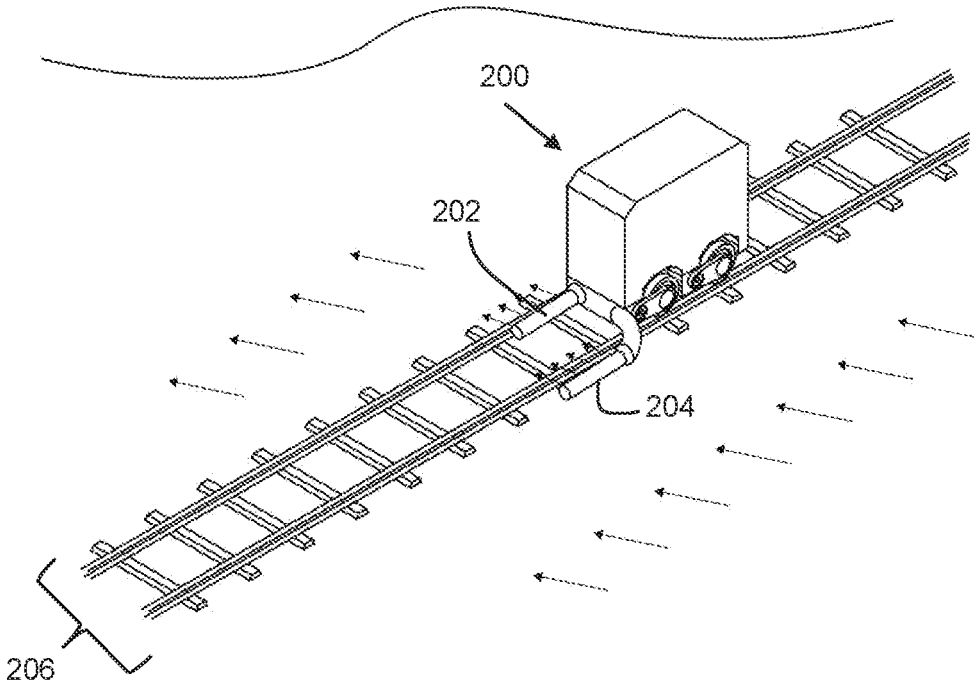
FIG. 4A is a three-dimensional view of an alternative exemplary railway track clearing vehicle according to aspects of the present disclosure, in which the vehicle has two conduits for directing airflow toward the track.
Figure 4B:
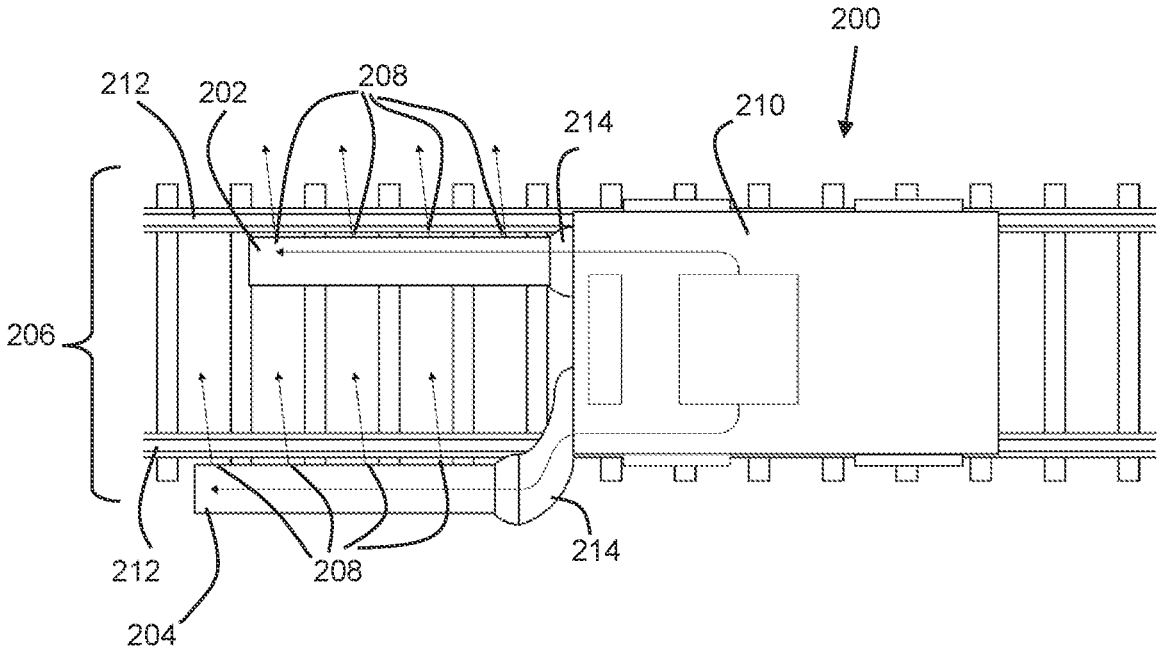
FIG. 4B is a top view of the vehicle shown in FIG. 4A.

FIGS. 4A and 4B show a three-dimensional view and top view, respectively, of another example embodiment of a railway track clearing vehicle (200). The vehicle (200) of this embodiment is substantially similar to the one shown in FIG. 3, provided that in this embodiment the vehicle (200) includes a conduit arrangement having two conduits (202, 204) configured to direct the airflow generated by the compressor toward the railway track (206). In addition, instead of having an outlet at the distal end of the conduit, the two conduits (202, 204) have a number of outlets (208) provided along the length of the conduits (202, 204) to thereby direct the airflow generated by the compressor at an angle, preferably transverse, to the direction of travel of the vehicle, i.e. transverse to the railway track (206).

As can be seen, the conduits (202, 204) are secured to the housing (210) of the vehicle (200) in such a way to enable movement thereof from locating internally of the railway track (206), to locating adjacent a rail (212) but externally of the track (206). In the embodiment shown in FIGS. 4A and 4B, the conduits (202, 204) are secured to the housing (210) by means of a section of flexible pipe (214), but any other suitable means may be used. For example, the conduits (202, 204) could also be secured to portions of the housing (210) that are capable of moving or extending away from the rest of the housing (210) such that the portion simply slides outwardly thereby moving the conduit from locating internally of the track (206) to then locating externally thereof. Similarly, the conduits (202, 204) are preferably configured to change the location of the outlets (208). In this regard, each conduit may include outlets on opposing sides thereof and be configured to close outlets as and when required. For example, when the conduit is located internally of the track, the outlets that located immediately adjacent to a rail may be open while the outlets on the opposing side of the conduit may be closed. If the conduit is then moved to located externally of the track, then the outlets that were first open may be closed while the outlets that were previously closed may be opened. It will be appreciated that the location of the conduits and the outlets may thus be varied as required, typically so that the outlets that are open are directed in the direction of wind blowing across the track so that the airflow that is directed through the outlets is able to lift the unwanted material from the track with the wind then carrying the unwanted material away from the track. Alternatively, the conduits may also be rotatable about their lengthwise axis, in which case outlets would only be required on one side of the conduit and the location of the outlets may be changed by simply rotation the conduit about its axis. It will be appreciated that other suitable means could similarly be employed.

In a preferred form, the embodiment in FIGS. 4A and 4B include two large rectangular conduits (202, 204) arranged next to each other with each conduit (202,204) symmetrically positioned over a respective rail (106). Each conduit (202,204) is moderately inclined towards the ground and slightly outwards. In one example, each conduit is preferably around 400 mm wide×60 mm high and the inclination angle is set at 45°. An outlet from the conduit is typically positioned at about 50 mm above the railway track. As an example, the exit jet velocity is set to around 85 m/s and produces a vertical loading of around 225 kg/m$^2$ on the sand surface that is assumed to be at rail head height, thus providing sufficient airflow impact to break up compacted or crusted sand.

Figure 5:
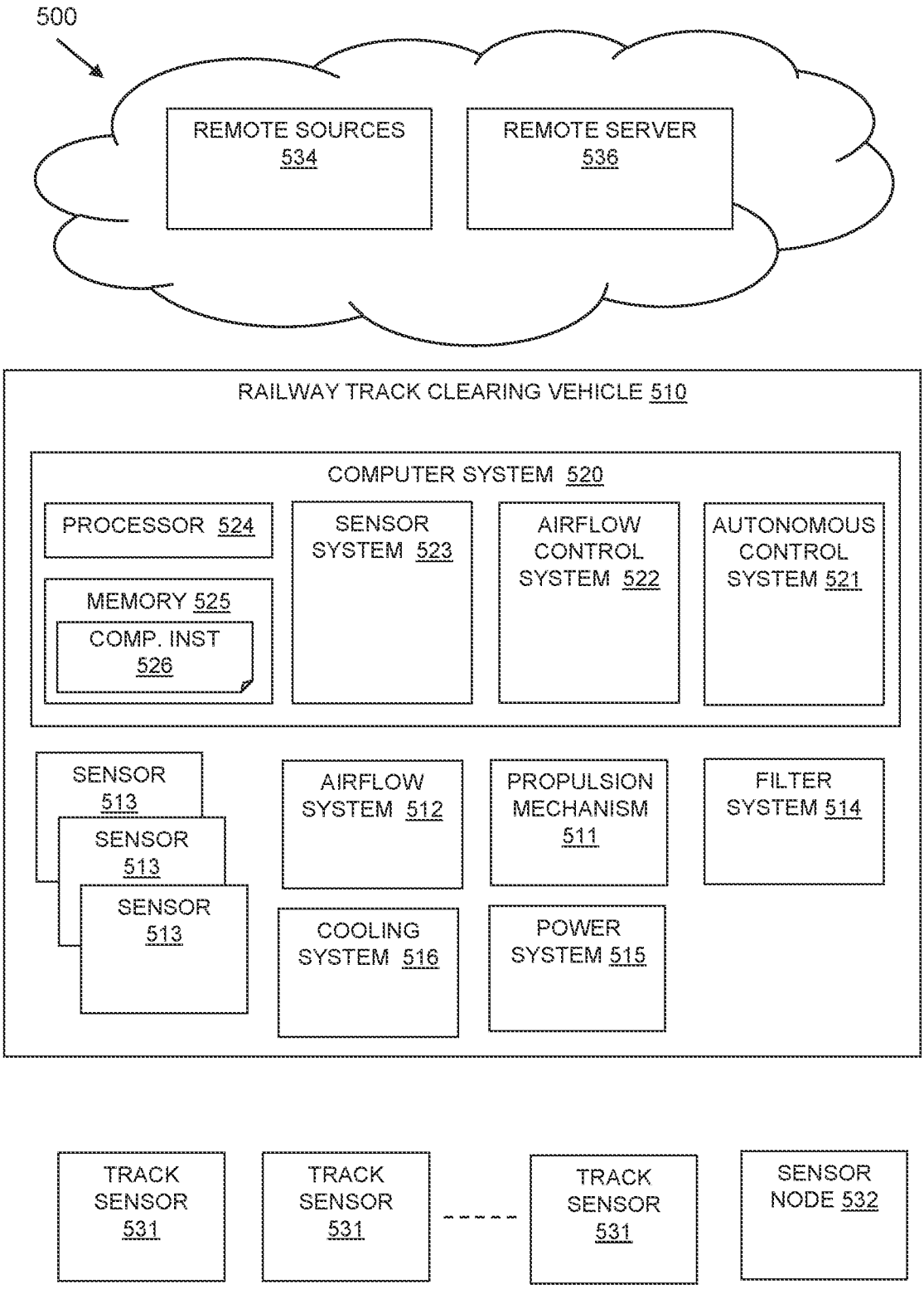
FIG. 5 is a block diagram of an exemplary railway track clearing vehicle and associated systems according to aspects of the present disclosure.

Referring to FIG. 5, a block diagram of an exemplary system (500) including a railway track clearing vehicle (510) and associated systems. The railway track clearing vehicle (510) includes a propulsion mechanism (511) for propulsion of the vehicle (510) along a track under the control of an autonomous control system (521). The vehicle (510) includes an airflow system (512) supported by the vehicle (510) and configured to provide and direct an airflow through at least one conduit towards the railway track under the control of an airflow control system (522).

The vehicle (510) may also include a filter system (514), a cooling system (516), and a power system (515). The power system (515) may comprise a diesel generator for powering the various systems onboard the vehicle. The power system (515) also includes a rechargeable battery to supplement power supplied by the generator and to operate the vehicle in a battery operation mode that may be sealed to the outside atmosphere of the vehicle for use during sand-blown conditions.

The cooling system (516) is preferably a combination of an active cooling system such as a liquid cooling system or HVAC system, and a passive cooling system configured to achieve cooling by means of insulated components and utilising airflow generated by the propulsion of the vehicle.

The filter system (514) is configured to entrap airborne particles, which may result from a railway track clearing operation or a heavy particle load in the surrounding atmosphere, thus preventing the particles from ingress into systems of the vehicle such as the propulsion system, the power system, the airflow system, the cooling system, and the computer system One or more computer systems (520) including one or more processors (524) and memory (525) configured to provide computer program instructions (526) to the processors (524) to execute the function autonomous control system (521), the airflow control system (522) and a sensor system (523) for obtaining sensor information providing information relating to unwanted material on an extent of a railway track. The airflow control system (512) controls the airflow system (512) by applying the sensor information to determine an airflow required to clear the extent of the railway track. The autonomous control system (521) autonomously controls the vehicle (510) on the extent of the railway track at a suitable speed according to continual feedback of the sensor information indicating a state of the unwanted material. The autonomous control system (521) may also communicate with a remote server (536) to receive operating instructions from the remote server (536) to operate the vehicle in accordance with the received instructions.

The sensor system (523) receives sensor data from multiple sensors (513) provided on the vehicle (510) and track sensors (531) on the railway track, with the sensors (513, 531) being configured to transmit the sensor data to the sensor system (523) directly or via a sensor node (532) for receiving sensor data from multiple sensors (531). The sensor system (523) may also receive data from remote sources (534) relating to external conditions of the vehicle and the extent of the railway track.

The computer system (520) may include one or more processors (524) for executing the functions of systems, which may be provided by hardware or by software units executing on the computer system (520). The software units may be stored in a memory component (525) and computer instructions (526) may be provided to the processor (524) to carry out the functionality of the described systems. In some cases, for example in a cloud computing implementation, software units arranged to manage and/or process data on behalf of the computer system (520) may be provided remotely. Some or all of the components may be provided by a software application downloadable onto and executable on the computer system (520).

Figure 6:
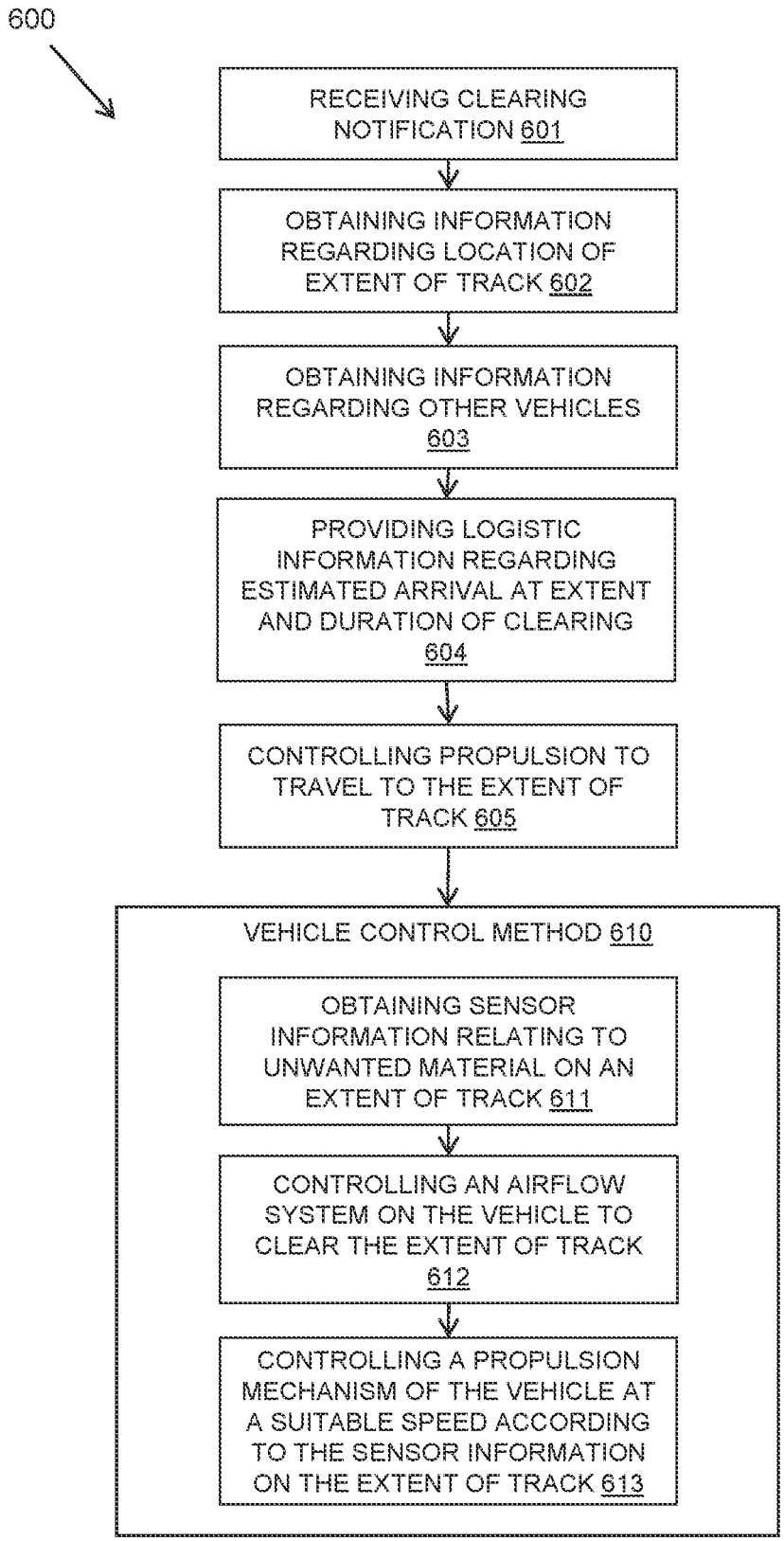
FIG. 6 is a flow diagram of an exemplary method carried out at a system of a railway track clearing vehicle according to an aspect of the present disclosure.

Referring to FIG. 6, a flow diagram (600) shows a method as carried out by a system (500) including a railway track clearing vehicle (510). The method may be carried out at one or more computer systems (520) at the vehicle (510) and, optionally, at a remote server (536) in constant or intermittent communication with the vehicle (510).

The method includes a vehicle control method (610) carried at one or more computer systems at the vehicle including: obtaining (611) sensor information providing information relating to unwanted material on an extent of a railway track; controlling (612) an airflow system supported by a railway track clearing vehicle and configured to provide and direct an airflow through at least one conduit towards the railway track by applying the sensor information to determine an airflow required to clear the extent of the railway track; and controlling (613) a propulsion mechanism of the railway track clearing vehicle to autonomously control the vehicle on the extent of the railway track at a suitable speed according to continual feedback of the sensor information indicating a state of the unwanted material.

The vehicle computer systems (520) may optionally communicate with a remote server (536) to transmit clearing progress notifications to the server to indicate the progress of a clearing operation being carried out by the vehicle.

A railway track clearing vehicle (510) may patrol areas of track by moving along the track and sensing and clearing any unwanted material in its path. Additionally, the vehicle may receive (601) a clearing operation notification indicating that a particular extent of railway track requires clearing and the notification may include information relating to the location of the extent of the railway track and the length thereof.

The clearing operation notification may be received (601) from a sensor along the railway track or a sensor node along the railway track configured to receive sensor information from a number of sensors along the railway track and to then transmit the sensor information to the computing system of the vehicle. For example, a clearing operation notification may be received (601) from an auditory sensor when wind-blown particles are sensed at a predetermined level. Alternatively, the sensor information may be sent to the remote server (536), which then sends a clearing notification to the computer system of the vehicle.

A clearing operation notification may also indicate a high level of wind-blown particles in the air sensed by a sensor such as the auditory sensor and may activate a sealed mode of operation by battery power only with no ingress of air.

A sensor located along a railway track may send an obstruction notification indicating that the sensor is being obstructed by unwanted material, the notification may include a unique identifier associated with the sensor. The method at the vehicle or remote server may include: retrieving, from a database, a list of unique identifiers and identifying the sensor from which the obstruction notification was received, and retrieving, from a database, location information of the identified sensor, the location information including the geographical coordinates of the sensor.

Additional steps may be taken to process the clearing operation notification. These may be carried out at the computer system of the vehicle, optionally with the aid of additional remote resources, or may be carried out by the remote server. Information may be obtained (602) regarding the location of the extent of the track having the unwanted material. Information may also be obtained (603) regarding other vehicles on the track and their scheduled movements. This may include obtaining information regarding any other vehicles travelling or scheduled to travel on the length of the railway track requiring clearing and coordinating a clearing operation of the length of the railway track to remove any unwanted material therefrom with the other vehicles' routes. Further to retrieving the location information of the sensor, the method may include: retrieving, from a database, train activity information for the railway track along which the sensor is located, the train activity information including information on trains traveling along the railway track; determining the duration required for the clearing vehicle to reach the geographic location of the sensor and to perform the clearing operation; and determining a suitable time frame for the clearing vehicle to perform the clearing operation without affecting the train traffic along the railway track.

Logistic information regarding an estimated arrival at the extent of the track and a duration of the clearing operation may be provided (604) by the vehicle to the remote server, vice versa, or to a third party.

The method at the vehicle may control (605) the propulsion mechanism of the railway track clearing vehicle so as to travel to the identified extent of railway track. Upon detecting arrival at the identified length of railway track, a clearing operation may commence according to the vehicle control method (610).

The method may incorporate the use of a battery system (not shown) which allows the vehicle to operate in a battery operation mode or to supplement power supply to the autonomous control system, the airflow system, the sensory system, the cooling system, or the filter system during operation. The battery operation mode may be triggered by a high load of airborne particles which is detected by one of the sensors of the sensory system. Preferably, the particle load in the air is detected by the auditory sensor which detects a predetermined level of noise generated by airborne particle. The battery system may also supply power to the relevant systems when the vehicle is in a standby mode, thereby to enable a "wake-up" signal to be detected when operation of the vehicle is required.

Figure 7:
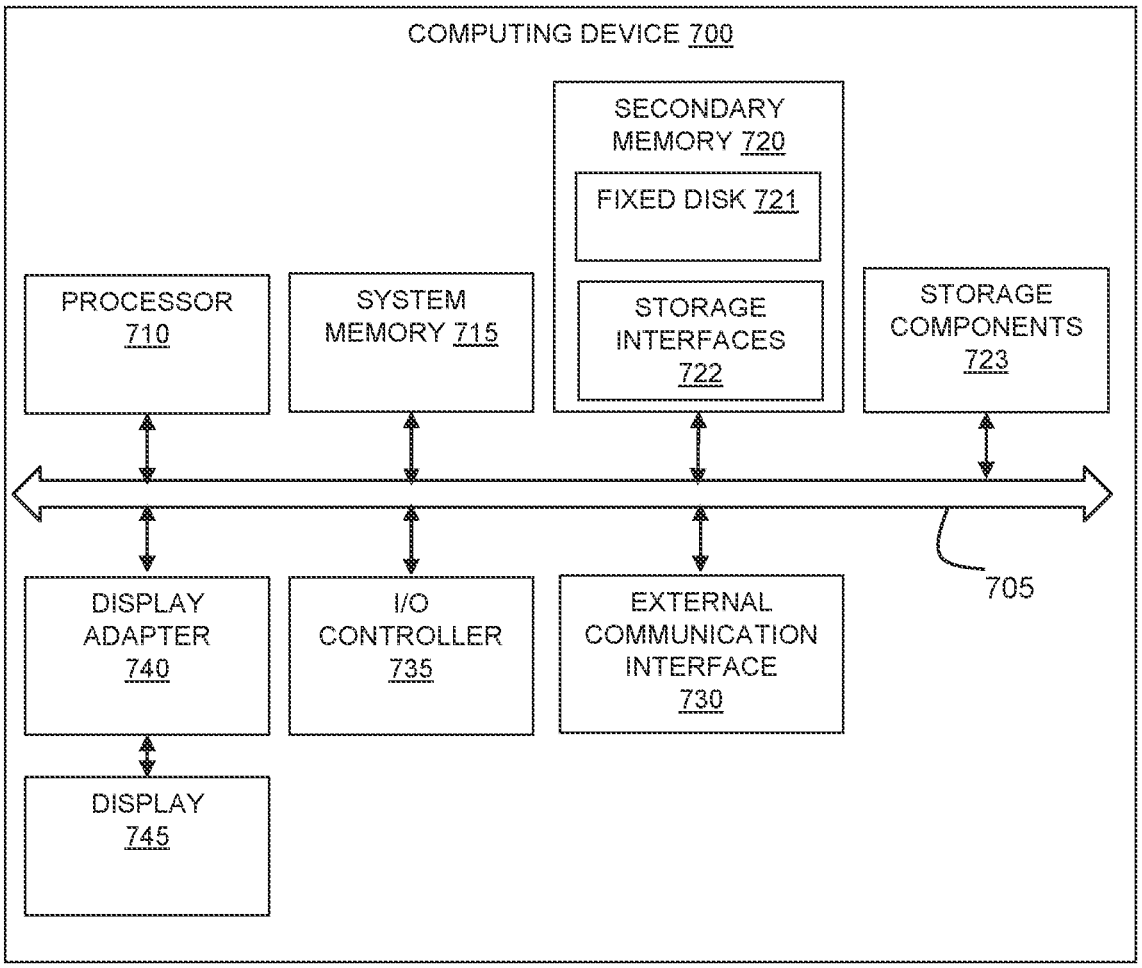
FIG. 7 is a block diagram of an exemplary computing device in which aspects of the present disclosure may be implemented.

FIG. 7 illustrates an example of a computing device (700) in which various aspects of the disclosure may be implemented. The computing device (700) may be embodied as any form of data processing device including a personal computing device (e.g. laptop or desktop computer), a server computer (which may be self-contained, physically distributed over a number of locations), a client computer, or a communication device, such as a mobile phone (e.g. cellular telephone), satellite phone, tablet computer, personal digital assistant or the like. Different embodiments of the computing device may dictate the inclusion or exclusion of various components or subsystems described below.

The computing device (700) may be suitable for storing and executing computer program code. The various participants and elements in the previously described system diagrams may use any suitable number of subsystems or components of the computing device (700) to facilitate the functions described herein. The computing device (700) may include subsystems or components interconnected via a communication infrastructure (705) (for example, a communications bus, a network, etc.). The computing device (700) may include one or more processors (710) and at least one memory component in the form of computer-readable media. The one or more processors (710) may include one or more of: CPUs, graphical processing units (CPUs), microprocessors, field programmable gate arrays (FPGAs), application specific integrated circuits (ASICs) and the like. In some configurations, a number of processors may be provided and may be arranged to carry out calculations simultaneously. In some implementations various subsystems or components of the computing device (700) may be distributed over a number of physical locations (e.g. in a distributed, cluster or cloud-based computing configuration) and appropriate software units may be arranged to manage and/or process data on behalf of remote devices.

The memory components may include system memory (715), which may include read only memory (ROM) and random access memory (RAM). A basic input/output system (BIOS) may be stored in ROM. System software may be stored in the system memory (715) including operating system software. The memory components may also include secondary memory (720). The secondary memory (720) may include a fixed disk (721), such as a hard disk drive, and, optionally, one or more storage interfaces (722) for interfacing with storage components (723), such as removable storage components (e.g. magnetic tape, optical disk, flash memory drive, external hard drive, removable memory chip, etc.), network attached storage components (e.g. NAS drives), remote storage components (e.g. cloud-based storage) or the like.

The computing device (700) may include an external communications interface (730) for operation of the computing device (700) in a networked environment enabling transfer of data between multiple computing devices (700) and/or the Internet. Data transferred via the external communications interface (730) may be in the form of signals, which may be electronic, electromagnetic, optical, radio, or other types of signal. The external communications interface (730) may enable communication of data between the computing device (700) and other computing devices including servers and external storage facilities. Web services may be accessible by and/or from the computing device (700) via the communications interface (730).

The external communications interface (730) may be configured for connection to wireless communication channels (e.g., a cellular telephone network, wireless local area network (e.g. using Wi-Fi™), satellite-phone network, Satellite Internet Network, etc.) and may include an associated wireless transfer element, such as an antenna and associated circuitry.

The computer-readable media in the form of the various memory components may provide storage of computer-executable instructions, data structures, program modules, software units and other data. A computer program product may be provided by a computer-readable medium having stored computer-readable program code executable by the central processor (710). A computer program product may be provided by a non-transient or non-transitory computer-readable medium, or may be provided via a signal or other transient or transitory means via the communications interface (730).

Interconnection via the communication infrastructure (705) allows the one or more processors (710) to communicate with each subsystem or component and to control the execution of instructions from the memory components, as well as the exchange of information between subsystems or components. Peripherals (such as printers, scanners, cameras, or the like) and input/output (I/O) devices (such as a mouse, touchpad, keyboard, microphone, touch-sensitive display, input buttons, speakers and the like) may couple to or be integrally formed with the computing device (700) either directly or via an I/O controller (735). One or more displays (745) (which may be touch-sensitive displays) may be coupled to or integrally formed with the computing device (700) via a display or video adapter (740).

The foregoing description has been presented for the purpose of illustration; it is not intended to be exhaustive or to limit the invention to the precise forms disclosed. Persons skilled in the relevant art can appreciate that many modifications and variations are possible in light of the above disclosure.

Any of the steps, operations, components or processes described herein may be performed or implemented with one or more hardware or software units, alone or in combination with other devices. In one embodiment, a software unit is implemented with a computer program product comprising a non-transient or non-transitory computer-readable medium containing computer program code, which can be executed by a processor for performing any or all of the steps, operations, or processes described. Software units or functions described in this application may be implemented as computer program code using any suitable computer language such as, for example, Java™, C++, or Perl™ using, for example, conventional or object-oriented techniques. The computer program code may be stored as a series of instructions, or commands on a non-transitory computer-readable medium, such as a random access memory (RAM), a read-only memory (ROM), a magnetic medium such as a hard-drive, or an optical medium such as a CD-ROM. Any such computer-readable medium may also reside on or within a single computational apparatus, and may be present on or within different computational apparatuses within a system or network.

Flowchart illustrations and block diagrams of methods, systems, and computer program products according to embodiments are used herein. Each block of the flowchart illustrations and/or block diagrams, and combinations of blocks in the flowchart illustrations and/or block diagrams, may provide functions which may be implemented by computer readable program instructions. In some alternative implementations, the functions identified by the blocks may take place in a different order to that shown in the flowchart illustrations.

Some portions of this description describe the embodiments of the invention in terms of algorithms and symbolic representations of operations on information. These algorithmic descriptions and representations, such as accompanying flow diagrams, are commonly used by those skilled in the data processing arts to convey the substance of their work effectively to others skilled in the art. These operations, while described functionally, computationally, or logically, are understood to be implemented by computer programs or equivalent electrical circuits, microcode, or the like. The described operations may be embodied in software, firmware, hardware, or any combinations thereof.

The foregoing description has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention set forth in any accompanying claims.

Finally, throughout the specification and any accompanying claims, unless the context requires otherwise, the word 'comprise' or variations such as 'comprises' or 'comprising' will be understood to imply the inclusion of a stated integer or group of integers but not the exclusion of any other integer or group of integers.

What is claimed:

1. A railway track clearing vehicle for removing unwanted material from a railway track, comprising:

a propulsion mechanism for propulsion of the vehicle along the track under the control of an autonomous control system;

an airflow system supported by the vehicle and configured to provide and direct an airflow through at least one conduit towards the railway track under the control of an airflow control system; and a sensor system configured to obtain sensor information providing information relating to unwanted material on an extent of a railway track and to detect levels of wind-blown particles in the air;

a power system for providing power to the propulsion mechanism, the air flow system, and the sensor system, wherein the power system includes a rechargeable battery system capable of running the vehicle in a sealed mode in which no ingress of air is required;

wherein the airflow control system applies the sensor information for providing and directing an airflow to the extent of the railway track to remove sensed unwanted material;

wherein the autonomous control system applies the sensor information for control of the propulsion mechanism for travel on the extent of the railway track at a suitable speed according to feedback of the sensor information indicating a state of the unwanted material; and wherein the power system applies sensor information indicating a high level of wind-blown particles in the air to activate a sealed mode of operation of the vehicle by battery power only with no ingress of air.

2. The vehicle as claimed in claim 1, wherein the airflow system includes an air compressor connected to the at least one conduit to supply the airflow under the control of the airflow control system and wherein the at least one conduit is arranged to be moveable to enable directing the airflow toward a desired location at or near the railway track according to the sensor information.

3. The vehicle as claimed in claim 1, wherein the airflow system includes two conduits each located adjacent one of two rails of the railway track and the conduits are moveable to change the location of the conduits from locating internally of the track between the rails to locating externally of the track and vice versa.

4. The vehicle as claimed in claim 1 which includes a filter system to prevent ingress of airborne particles generated by a railway track clearing operation in to any one of: the propulsion mechanism, the autonomous control system, or the airflow system.

5. The vehicle as claimed in claim 1, wherein the sensor system includes a processor configured: to receive sensor data from multiple sensors configured to sense predetermined conditions relevant for the vehicle's clearing operation, to process the sensor data to obtain the sensor information relating to unwanted material, and to transmit the sensor information to the airflow control system and the autonomous control system.

6. The vehicle as claimed in claim 1, wherein the sensor system receives sensor data from multiple sensors provided on the vehicle and/or on the railway track and the sensors being configured to transmit the sensor data to the sensor system directly or via a sensor node for receiving sensor data from multiple sensors.

7. The vehicle as claimed in claim 1, wherein the sensor system receives data from remote sources relating to external conditions of the vehicle and the extent of the railway track.

8. The vehicle as claimed in claim 1, wherein the sensor system receives sensor data from multiple sensors of the form of one or more of: a radar sensor capable of detecting unwanted material on the railway track, a wind speed and direction sensor capable of determining the speed and direction of wind traveling over or across the railway track, an auditory sensor capable of detecting a sound made by windblown particles, a visual sensor capable of collecting images or video feed of the railway track conditions.

9. The vehicle as claimed in claim 1 wherein the battery system supplies power to the propulsion mechanism, the air flow system, and the sensor system, when the vehicle is in standby mode, thereby to enable a "wake-up" signal to be detected when operation of the vehicle is required.

10. A computer-implemented method for removing unwanted material from a railway track, comprising:

obtaining sensor information providing information relating to unwanted material on an extent of a railway track and detecting levels of wind-blown particles in the air;

controlling an airflow system supported by a railway track clearing vehicle and configured to provide and direct an airflow through at least one conduit towards the railway track by applying the sensor information to determine an airflow required to clear the extent of the railway track;

controlling a propulsion mechanism of the railway track clearing vehicle to autonomously control the vehicle on the extent of the railway track at a suitable speed according to feedback of the sensor information indicating a state of the unwanted material; and wherein in response to a clearing operation notification received from a sensor indicating a high level of wind-blown particles in the air, activating a sealed mode of operation of the vehicle by battery power only with no ingress of air.

11. The method as claimed in claim 10, wherein the method is carried out at a railway track clearing vehicle and includes communicating with a remote server and transmitting clearing progress notifications to the server to indicate the progress of a clearing operation being carried out by the vehicle.

12. The method as claimed in claim 10, wherein the method includes:

receiving a clearing operation notification indicating that an extent of railway track requires clearing, the notification including information relating to a location of the extent of railway track and the length thereof;

controlling the propulsion mechanism of the railway track clearing vehicle so as to travel to the identified extent of railway track; and upon detecting arrival at the identified extent of railway track, commencing a clearing operation including controlling the airflow system to direct airflow toward the railway track so as to remove any unwanted material therefrom.

13. The method as claimed in claim 12, wherein the clearing operation notification is received from any one of: a sensor along the railway track, a sensor node along the railway track configured to receive sensor information from a number of sensors along the railway track and to then transmit the sensor information to a computing device, and a remote server.

14. The method as claimed in claim 12, including, in response to receiving a clearing operation notification:

obtaining information regarding any other vehicles travelling or scheduled to travel on the extent of the railway track requiring clearing; and coordinating a clearing operation of the extent of the railway track to remove any unwanted material therefrom with the other vehicles' routes.

15. The method as claimed in claim 10, including:

receiving, from a sensor located along a railway track, an obstruction notification indicating that the sensor is being obstructed by unwanted material, the notification including a unique identifier associated with the sensor; and transmitting a clearing operation notification to the railway track clearing vehicle to cause the railway track clearing vehicle to travel along the railway track to a location of the sensor and commence a clearing operation of the railway tracks so as to remove any unwanted material therefrom.

16. The method as claimed in claim 15, wherein the obstruction notification includes a unique identifier associated with the sensor and the method includes:

retrieving, from a database, a list of unique identifiers and identifying the sensor from which the obstruction notification was received; and retrieving, from a database, location information of the identified sensor, the location information including the geographical coordinates of the sensor.

17. The method as claimed in claim 15, in response to retrieving a location information of the sensor, the method including:

retrieving, from a database, train activity information for the railway track along which the sensor is located, the train activity information including information on trains traveling along the railway track;

determining the duration required for the clearing vehicle to reach the geographic location of the sensor and to perform the clearing operation; and determining a suitable time frame for the clearing vehicle to perform the clearing operation without affecting the train traffic along the railway track.

18. A computer system for removing unwanted material from a railway track by a railway track clearing vehicle, comprising:

one or more processors and memory configured to provide computer program instructions to the processors to execute the function of the following systems:

a sensor system for obtaining sensor information providing information relating to unwanted material on an extent of a railway track and to detect levels of wind-blown particles in the air;

an airflow control system for controlling an airflow system supported by a railway track clearing vehicle and configured to provide and direct an airflow through at least one conduit towards the railway track by applying the sensor information to determine an airflow required to clear the extent of the railway track;

an autonomous control system for controlling a propulsion mechanism of the railway track clearing vehicle to autonomously control the vehicle on the extent of the railway track at a suitable speed according to feedback of the sensor information indicating a state of the unwanted material; and a sealed mode system for, in response to a clearing operation notification received from a sensor indicates a high level of wind-blown particles in the air, activating a sealed mode of operation of the vehicle by battery power only with no ingress of air.

* * * * *